US006220786B1

(12) United States Patent
Ollason et al.

(10) Patent No.: US 6,220,786 B1
(45) Date of Patent: Apr. 24, 2001

(54) UNDERWATER BURIAL APPARATUS

(75) Inventors: Andrew Stuart Ollason, Braintree; Graham Peter Wallace, High Garrett, both of (GB); Kevin Clyde Peterson, Stuart, FL (US)

(73) Assignee: Cable & Wireless PLC, London (GB)

( * ) Notice: Subject to any disclaimer, the term of this patent is extended or adjusted under 35 U.S.C. 154(b) by 0 days.

(21) Appl. No.: 09/185,724

(22) Filed: Nov. 4, 1998

Related U.S. Application Data

(63) Continuation of application No. PCT/GB97/01534, filed on Jun. 9, 1997.

(30) Foreign Application Priority Data

Jun. 7, 1997 (GB) ..... 9611900

(51) Int. Cl.[7] ..... F16L 1/12; E02F 3/14
(52) U.S. Cl. ..... 405/159; 37/465; 405/161
(58) Field of Search ..... 405/161, 162, 405/160, 159, 174; 37/463, 465

(56) References Cited

U.S. PATENT DOCUMENTS 3,097,466 * 7/1963 King ..... 405/174 X
3,103,790 * 9/1963 Popich .
3,354,660 * 11/1967 Vaughan ..... 405/174
3,978,679 * 9/1976 Lecomte ..... 405/159
3,995,439 * 12/1976 Hahlbrock ..... 405/161
4,022,028 * 5/1977 Martin .
4,043,135 * 8/1977 Hoes et al. ..... 405/174
4,872,275 * 10/1989 Beckett et al. .
5,224,797 * 7/1993 Vaughan ..... 405/74 X

FOREIGN PATENT DOCUMENTS

2837322 * 8/1979 (DE) .
7414393 * 5/1975 (NL) .

* cited by examiner

*Primary Examiner*—Dennis L. Taylor
(74) *Attorney, Agent, or Firm*—Pillsbury Madison & Sutro LLP

(57) ABSTRACT

Apparatus for locally disturbing an underwater bed to enable the burial of an elongate member (39) comprises a mounting (30,31), resilient means (88–93) such as brush filaments coupled to the mounting, and means (9) for moving the resilient means with respect to the mounting. The resilient means is constructed such that on moving the mounting along the line of the elongate member while moving the resilient means with respect to the mounting, the underwater bed is disturbed by the resilient means to enable the elongate member to be buried.

24 Claims, 8 Drawing Sheets

UNDERWATER BURIAL APPARATUS

This is a Continuation of International application. Ser. No. PCT/GB97/01534 filed Jun. 9,1997 which designated the U.S.

The present invention relates to a method and apparatus to enable the underwater burial of an elongate member, such as a cable or pipe.

Post lay burial of underwater telecoms cables is normally carried out in soft silt or sand soils (hereinafter "soil") by means of water jetting. This method is employed in preference to mechanical soil cutting devices as low pressure water jets will not damage the polythene outer covering of the cable and has the advantage of requiring little mechanical contact with the cable. There are various types of water jetting tools in use but they all work on essentially the same principle. Jetting swords or nozzles are directed at the seabed on each side of the cable and fluidise the soil allowing the cable to be imbedded. The disadvantage of water jetting systems is that they are inefficient. For every kW of water power directed at the seabed an equal amount has to be directed in the opposite direction to balance the reactive forces. Typically, powers of greater than 75 kW are absorbed by the tool alone to bury a cable in soft soils and sand at an acceptable rate. The neutrally buoyant Remotely Operated Vehicle (ROV) to which the tool is attached requires at least the same amount of power again in order to effectively transport it in deep water.

Mechanical soil cutting devices are only used in soils too hard to effectively fluidise, such as consolidated clays of greater than 50 kPa shear strength, chalk and rock. These tools are generally toothed wheels or chain cutters and in use require that the cable is first "loaded" into a protective chute and depressor to prevent contact between the cutting surfaces and the cable. The fact that the cable needs to be loaded creates the need for complicated subsea robotics both for loading and unloading the cable as well as mechanisms for automatic ejection, in the event of loss of vehicle power. Because of the size and weight of conventional mechanical cutting tools and their associated equipment, they can only be deployed from heavy subsea tractors, typically weighing greater than 12 tonnes. Whilst necessary for burial of pre-laid cables in hard materials, they are of limited use in areas of soft seabed as they tend to sink into the soil.

Both of the solutions above are of necessity powerful and hence expensive. Consequently they are both, together with their launching and control systems, very large (in excess of 100 tonnes), they are expensive to transport and can only be launched from cableships and offshore vessels with strong, spacious decks.

The emerging single span and festoon cable systems business however is dictating the need for lower cost shallow water cable deburial, retrieval and reburial solutions. The maintenance requirements for such low cost cable systems will not stand the cost of permanently based vessels of size necessary to deploy a modern 250 hp, 130 tonne cable maintenance ROV nor indeed will they support the cost of such an ROV on standby.

It would therefore be advantageous to devise a method for imbedding cable in soft soils using low power.

In accordance with a first aspect of the present invention there is provided apparatus for locally disturbing an underwater bed in a line so as to enable the burial of an elongate member, the apparatus comprising a mounting, resilient means coupled to the mounting, and means for moving the resilient means with respect to the mounting, wherein the resilient means is constructed such that on moving the mounting along the line while moving the resilient means with respect to the mounting, the underwater bed is disturbed by the resilient means to enable the elongate member to be buried.

In most cases the resilient means will move soil mechanically but it has been found that in addition the resilient means agitates the water and creates an eddy effect which at least partially disturbs and fluidises the bed (which may be a seabed, riverbed, lakebed etc.) in the region of a cutting face. In some cases the eddy current effect could be used alone with no contact between the resilient means and the bed.

It has been recognised that jetting with low power such as 9 kw is not practical to trench depths in excess of 600 mm which leaves some form of mechanical method as the only approach. It has also been recognised that a conventional mechanical tool would not be feasible because the associated loading/unloading and ejection equipment would be large and costly.

It has been found that the disadvantages of the conventional mechanical approach (which uses rigid toothed wheels or chain cutters) can be avoided by the provision of resilient means. The resilient means is generally stiff enough to cause disturbance of the water adjacent the cutting face and apparent fluidisation of the disturbed soil at or adjacent the advancing cutting face, whilst being flexible enough to contact the elongate member, such as a cable, without causing any damage.

The resilient means may comprise any suitable resilient member or members. For instance the resilient means may comprise one or more strips of rubber which extend from a rotating axle. Preferably however the resilient means comprises a plurality of elongate resilient members such as brush filaments. The density, length and flexibility of the resilient members can be suitably chosen for the type of bed material, type of elongate member (e.g. telecommunications cable), cutting depth and cutting speed required. The brush filaments may be formed from any suitable material such as metal or stiff plastic. The stiffness of the filaments of a conventional varnish stripping brush has been found to be suitable. In one example nylon brush filaments are used with a diameter in the range of 1–2 mm, and a length in the range of 20–30 mm.

The resilient means may be oscillated with respect to the mounting, or mounted on a conveyor belt. However preferably the resilient means are rotated with respect to the mounting, and typically extend from an axle rotatably coupled to the mounting. In this case the means for moving the resilient means with respect to the mounting comprises drive means for rotating the axle. This provides a simple low power solution. Where the resilient means comprises a plurality of elongate resilient members such as brush filaments the filaments preferably extend radially from the axle.

The axle may be inclined or perpendicular to a vertical plane passing through the line of disturbance. However preferably the axle is mounted and deployed (for instance from an ROV) such that, in use, the axle lies substantially parallel to a vertical plane passing through the line of disturbance. This ensures that when the elongate member is buried at the same time, it is not damaged by rigid rotating components.

The resilient means may be uniformly distributed about the axle but preferably is arranged as a plurality of arms circumferentially spaced around the axle. We believe that the spaced arms are more efficient in effecting fluidisation of the underwater bed material by means of a "fanning" effect, resulting in a lower power requirement.

In one example the resilient means is arranged as a plurality of groups axially spaced along the axle. In a preferred embodiment the resilient means is arranged as twenty axially spaced groups. In an alternative example, the resilient means may be in the form of one or more spirals extending along the length of the axle. The radial length of each group (eg the length of the brush filaments) and the axial spacing (eg. the spacing between the groups or the pitch of the spiral) can be suitably chosen for the depth of trench required and the angle of deployment of the axle. In preferred examples the groups are spaced by 50–100 mm and the spiral has a pitch of 18–38 mm.

Typically the resilient means extends downwards in use into the underwater bed, and in a preferred embodiment the resilient means is non-uniformly distributed such that, in use, the density of the resilient means increases downwards into the underwater bed. For instance the axial spacing between groups of resilient means or the pitch of the spiral may decrease along the length of the axle. This results in improved burial efficiency since the majority of the fluidisation work is carried out in a lower region of the underwater bed.

Preferably the apparatus further comprises a second axle rotatably coupled to the mounting substantially parallel to the first axle and having resilient means extending therefrom. In this case the pair of rotating resilient means disturbs the underwater bed on either side of the elongate member, forming a trench which receives the elongate member. The walls of the trench collapse behind the apparatus and bury the elongate member to an extent dependent on the stiffness of the underwater bed material. The apparatus is particularly suited for operation in soft seabed materials such as soft soil or sand.

The apparatus typically further comprises means for guiding an elongate member (eg cable) in use into the underwater bed. The means for guiding an elongate member may comprise, for example, one or more depressors such as depressor rollers.

Typically the apparatus further comprises deployment means such as a hydraulic cylinder for deploying the mounting between a raised position and a lowered position. The mounting may be deployed by rotating the mounting or by sliding the mounting between its raised and lowered positions. Slidably deploying the mounting has the advantage that the mounting can be arranged at a fixed optimum angle which does not vary with the depth of burial.

The apparatus preferably comprises a mechanical depressor (such as one or more depressor rollers) which applies a downward pressure to the elongate member to force the elongate member into the trench being excavated. However in the case where there are two axles and both are rotated so as to create a downward force between the axles, the downward force created by the resilient means and the associated fluid flow may remove the requirement for a mechanical depressor. This reduces the resistance to movement along the line of disturbance, further reducing the power requirement for the vehicle drive. It also reduces the post burial tension in the buried elongate member.

In one example the apparatus further comprises means for delivering a fluid (eg. a liquid such as water) in the region of the resilient means. This provides a lubricating effect which improves the efficiency of the apparatus. Preferably the lubricating water is delivered in the region of a lower end of the apparatus since the seabed will generally be dryer in this region.

The apparatus is typically mounted to an ROV. The ROV may be a neutrally buoyant, free-swimming vehicle. Alternatively the ROV may be a negatively buoyant vehicle.

In accordance with a second aspect of the present invention there is provided a method of locally disturbing an underwater bed in a line to enable the burial of an elongate member, the method comprising moving apparatus according to the first aspect of the present invention along the line while moving the resilient means with respect to the mounting whereby the underwater bed is disturbed by the resilient means to enable the elongate member to be buried.

The method may be carried out before the elongate member is laid on the underwater bed, providing a trench in which the elongate member is laid. Preferably however the underwater bed is disturbed along the line of a previously laid elongate member.

Preferably the underwater bed is formed with material of less than approximately 30 kPa shear strength, such as soft soil or sand.

The method may be employed to bury any type of elongate member including undersea gas or oil pipes but is particularly suited to the burial of flexible elongate members such as telecommunications cable. Typically the method is employed to bury cable in soft soils or sand up to a depth of approximately 600–1000 mm. An example of a method and apparatus according to the invention will now be described with reference to the accompanying drawings, in which.

Figure 1:
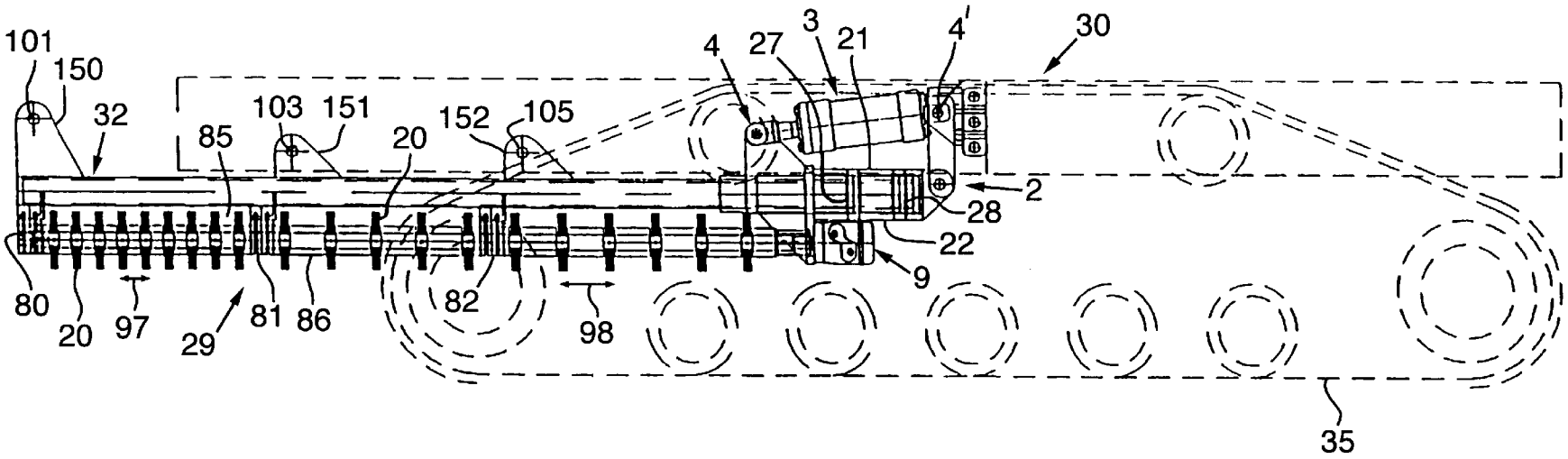
FIG.1 is a side view of an ROV fitted with a paddle brush cable burial device.
Figure 2:
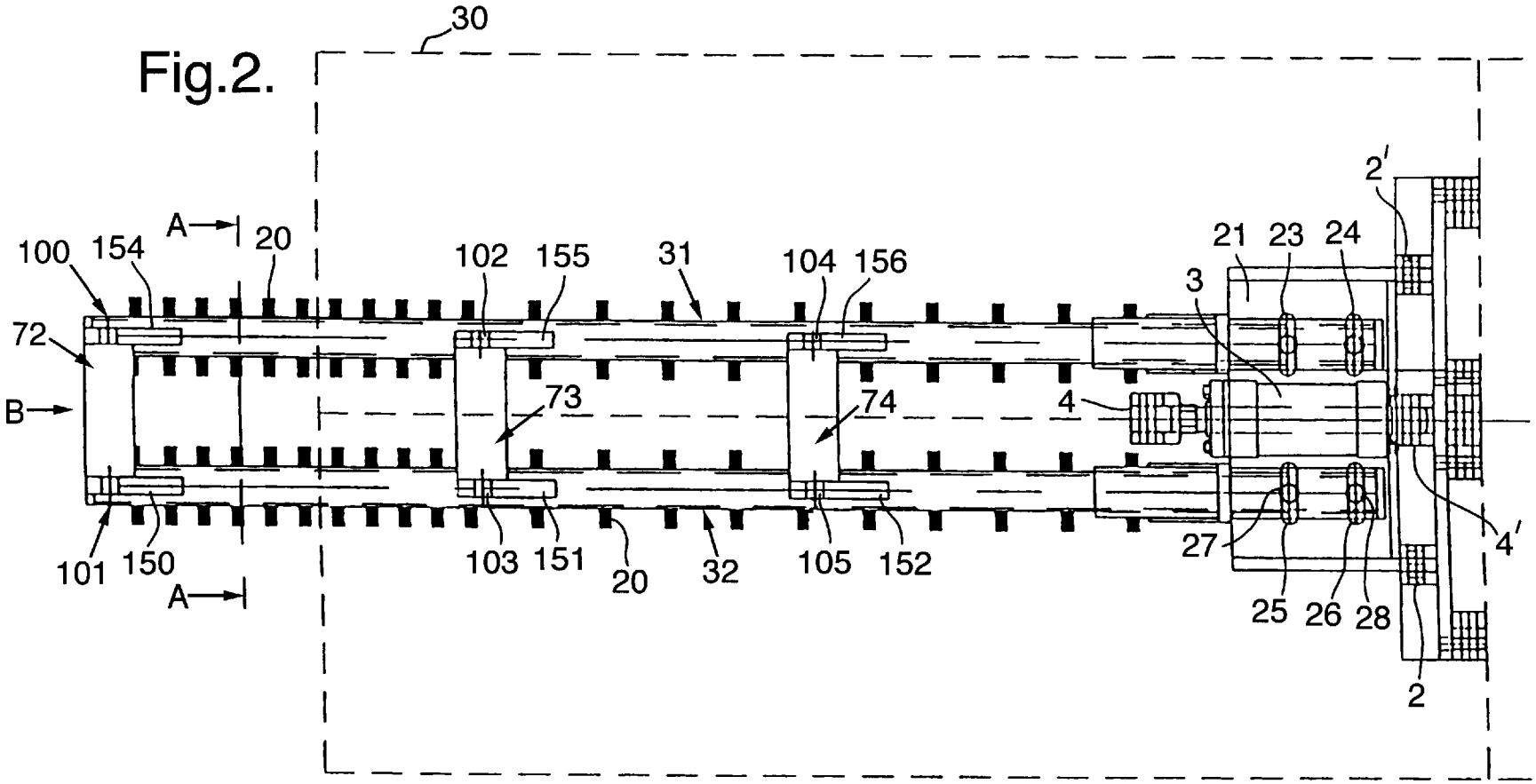
FIG. 2 is a plan view of the ROV of FIG. 1 with the ROV tracks omitted for clarity.

Referring to FIGS. 1 and 2, an underwater ROV 30 has a cable burial device 29 mounted on its underside. The cable burial device comprises a pair of hollow mounting arms 31,32 which are pivotally attached to the ROV via a bracket. The bracket has an upper plate 21 and lower plate 22 which define a space which receives the arms 31,32. The upper plate 21 and lower plate 22 each have four elongate slots, the slots 23–26 formed in the upper plate being shown in FIG. 2. The arms 31,32 are fixed in place with bolts which pass through the arms 31,32 and the corresponding slots in the upper and lower plates 21,22. Two of the bolts 27,28 are indicated in FIGS. 1 and 2. The slots 23–26 enable the lateral spacing between the arms 31,32 to be varied as desired. The bracket is rotatably mounted to the ROV 30 at a pair of hinge points 2,2'. An hydraulic deployment cylinder 3 is pivotally mounted to the bracket at 4 and to the main body of the ROV at 4' and can be actuated to deploy the arms 31,32 from a horizontal raised position (FIG. 1), to an angled operative position (shown in FIG. 5).

The arms 31,32 each carry three rotary bearings 80–82. Two axles 5,6 (shown in cross-section in FIG. 3) are rotatably mounted in the bearings 80–82. The axles 5,6 are each driven by respective hydraulic motors, the left-hand hydraulic motor 9 being illustrated in FIG. 1. The axle 6 has a respective hydraulic motor hidden by the motor 9 in FIG. 1.

Figure 3:
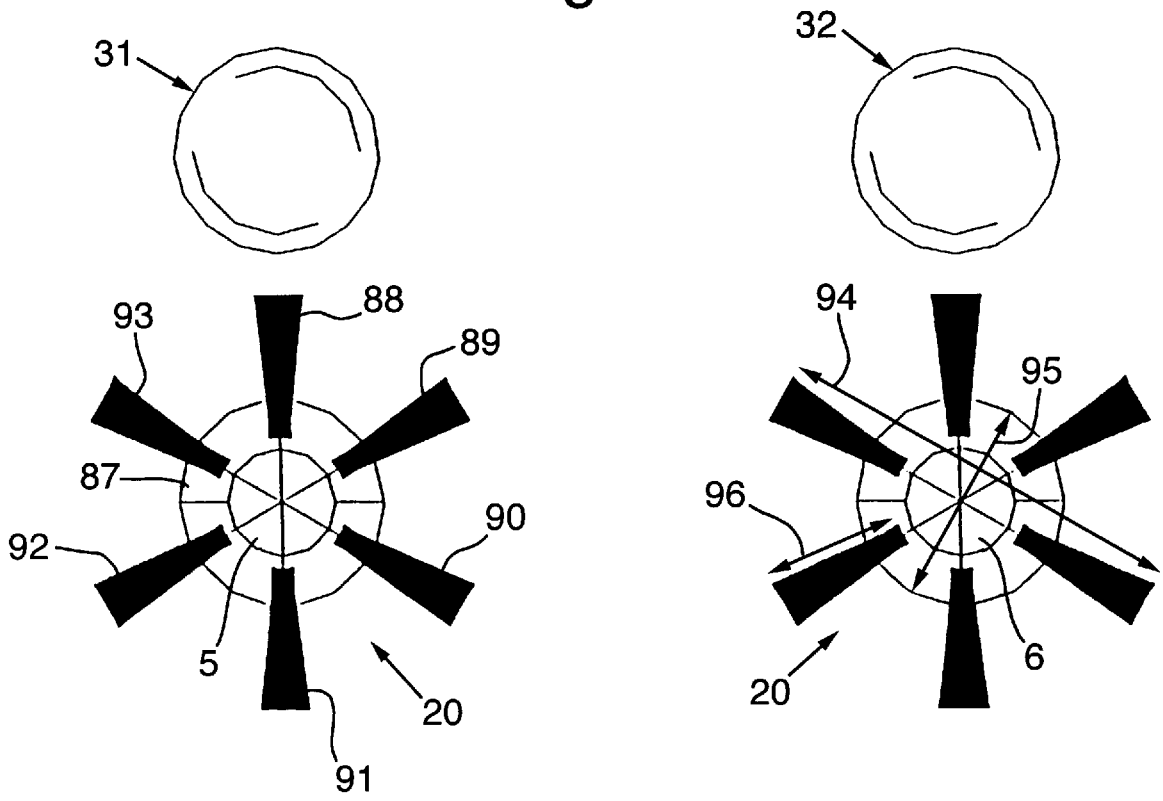
FIG. 3 is a section along line A—A in FIG. 2.

Twenty paddle brush assemblies 20 (some of which are labelled in FIGS. 1 and 2) are mounted on the axles 5,6, adjacent pairs of brush assemblies being separated by nylon spacers 85,86 etc. Referring to FIG. 3, each brush assembly 20 comprises an annular brush holder 87 threaded onto a respective one of the axles 5,6 and fixed in place with grub screws or keyways (not shown). Each brush holder 87 has six slots which each retain a radially extending brush 88–93. The brush holder has a body diameter 95 of 60 mm. The overall diameter 94 of the brush assembly is 110 mm. The brushes 88–93 are each made up of grit impregnated nylon filaments with a filament diameter of 1.5 mm and a trim length 96 of 25 mm. The brush length (i.e. the length of the brushes 88–93 parallel to the axles 5,6) is 25 mm. The nine brush assemblies between the two rear bearings 80,81 are more closely spaced and have an axial spacing 97 of 50 mm. The remaining eleven brush assemblies are more widely spaced with an axial spacing 98 of 100 mm.

Figure 4:
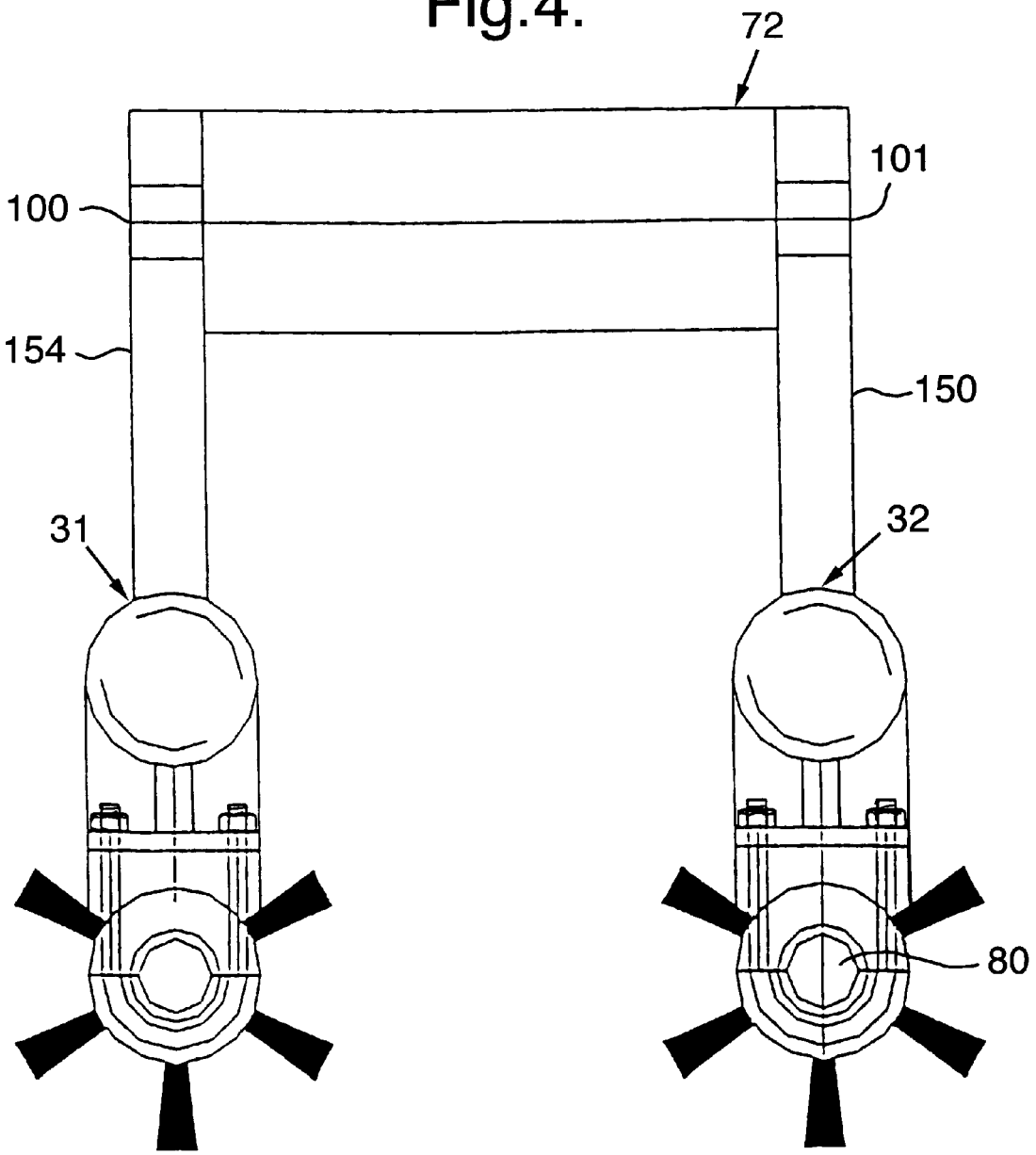
FIG. 4 is an end view in direction B shown in FIG. 2.

The arms 31,32 also carry depressor support brackets 150–152,154–156 which carry depressor bearings 100–105. Nylon depressor rollers 72–74 are rotatably mounted in respective pairs of the depressor bearings 100–105. The raised rear depressor roller 72 is shown in FIG. 4.

Figure 5:
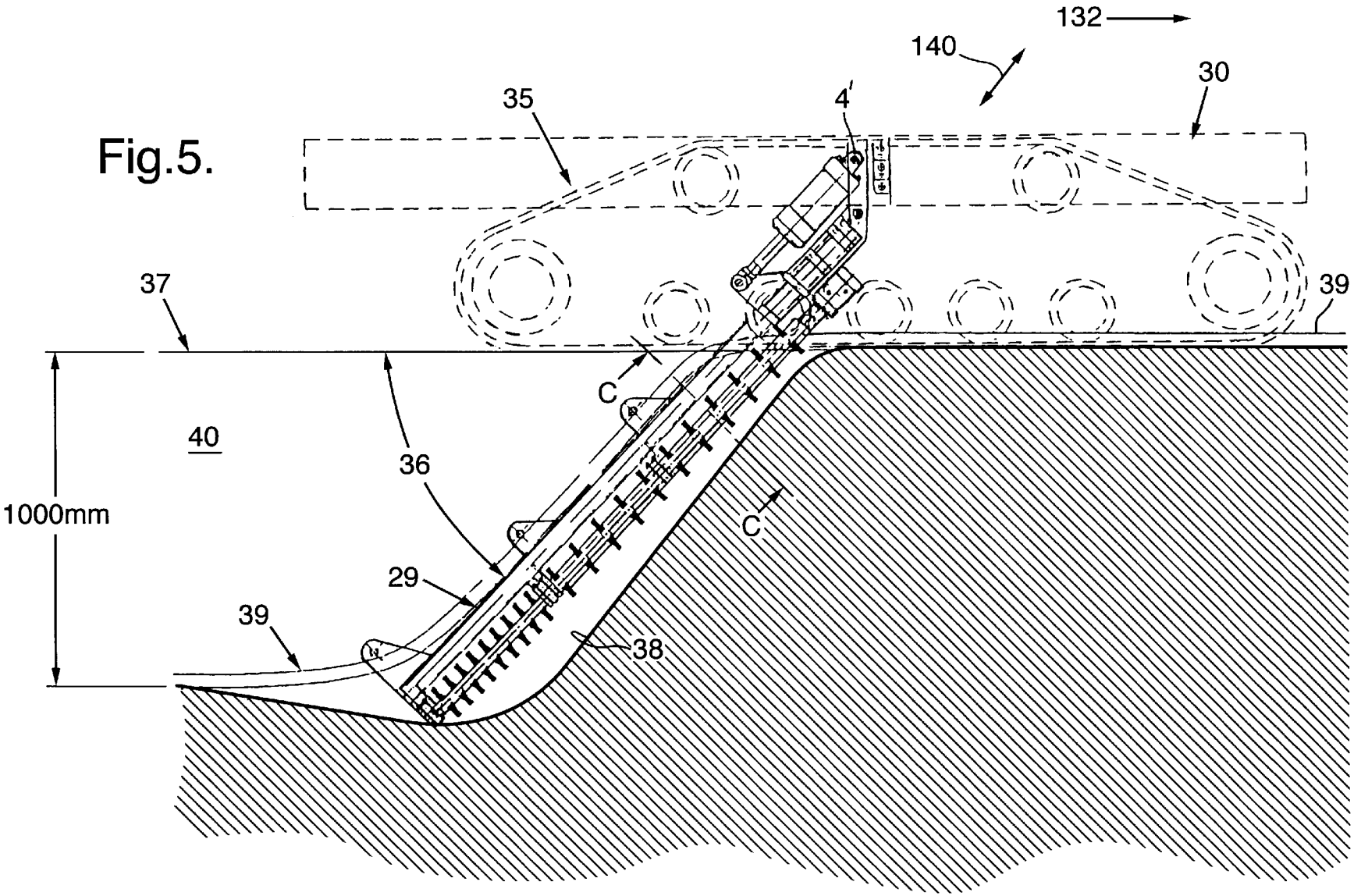
FIG. 5 is a side view of the ROV of FIG. 1 burying a cable.

FIG. 5 is a side view of the ROV 30 burying a cable 39 which has been previously laid on the seabed. Power and control is supplied to the ROV 30 from a surface vessel via an umbilical (not shown). The ROV 30 advances in the direction 132 along the seabed 37 on a pair of tracks (right-hand track 35 being shown in FIGS. 1 and 5) along the line of the cable 39 to be buried.

The angle of deployment 36 is suitably adjusted for the required burial depth and cable bend radius. In this example the angle of deployment 36 is 45° and the depth of burial is 1000 mm. As can be seen in FIG. 5, the spacing of the upper brush assemblies and the trim length of the brush filaments is chosen such that at the chosen angle of 45°, when viewed in the direction of travel 132 the brush assemblies overlap slightly.

The cable 39 in advance of the device 29 lies on the seabed 37. As the ROV advances, a cutting face 38 is continuously mechanically cut away and disturbed or fluidised by the action of the brushes to form a trench 40. The cable 39 is guided into the trench by the depressor rollers 72–74. The rear depressor roller 72 is mounted higher than the other two rollers 73,74 to maintain a minimum bend radius of 1.5 metres for the cable 39. The soft soil or sand forming the walls of the trench collapses almost immediately behind the device to bury the cable 39 behind the device.

The rotation of the brushes generates turbulence in the trench 40. The brushes also come into contact with the cutting face. The combined effect of the agitation of the water near the cutting face and the mechanical contact of the brushes with the cutting face 38 causes the cutting face to be cut away or at least partially fluidised to enable the cable 39 to be buried. If the brushes come into contact with the cable 39 their flexibility ensures that the cable is not damaged. The resilience of the brushes ensures that the brushes which have contacted the cable return to their original shape.

The axles 5,6 may each be rotated clockwise or anti-clockwise at up to 500 revolutions per minute. In one example the axles are rotated such that the left-hand axle (viewed from the front or the rear) is rotated clockwise and the right-hand axle is rotated anticlockwise. In a second example the axles are rotated such that the left-hand axle is rotated anti-clockwise and the right-hand axle is rotated clockwise. It has been observed that the power consumption is slightly lower when the left-hand axle is rotated anti-clockwise and the right-hand axle is rotated clockwise.

In an alternative arrangement (not shown) the arms 30,31 may be slidably mounted to the ROV at a desired angle and deployed as indicated at 140 in FIG. 5.

Figure 6:
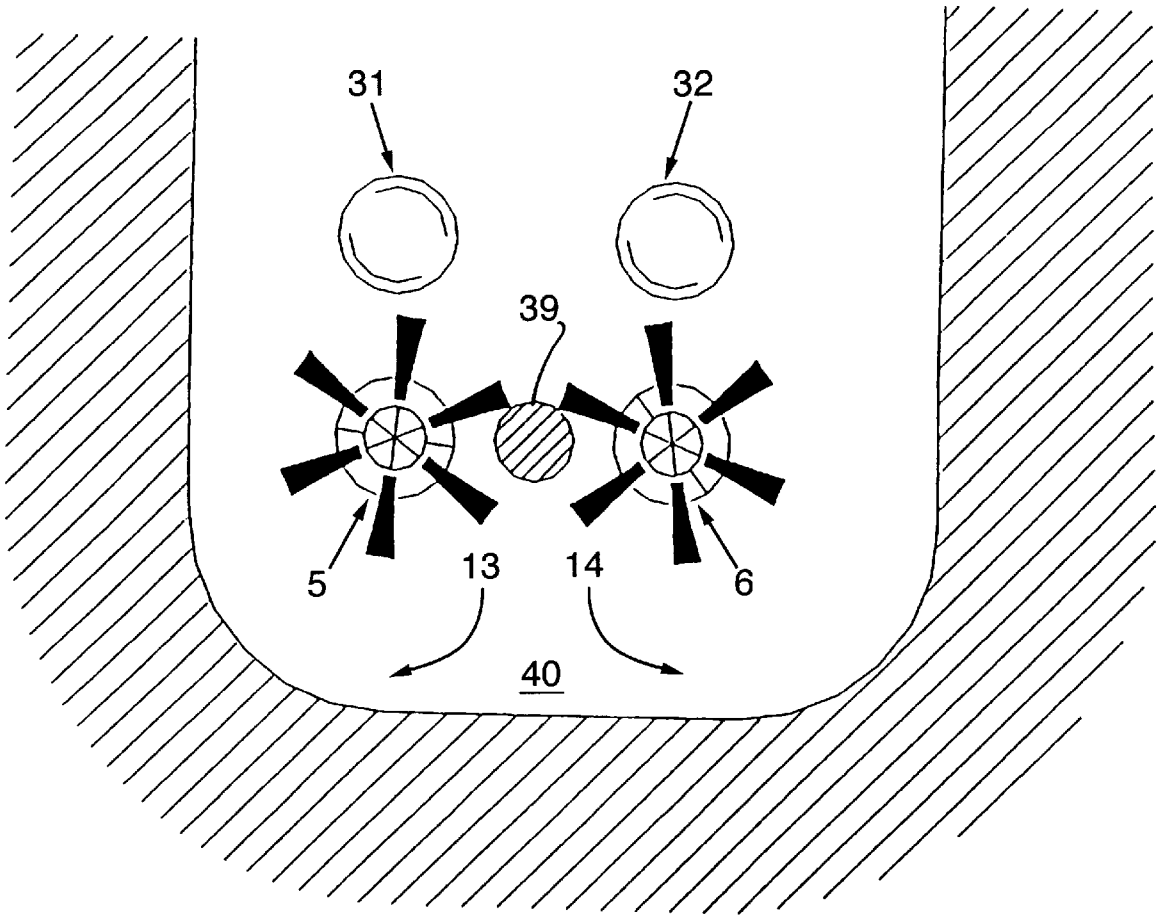
FIG. 6 is a schematic cross-section of a cable burial device showing the interaction of the cable with the brushes.

FIG. 6 is a cross-sectional view of the device 29 burying a cable 39. However, in the example of FIG. 6 the arms 31,32 have been moved inwardly to the maximum extent permitted by the slots 23–26. The axles 5,6 are both driven inwardly downwards as indicated at 13,14. As a result the brushes which contact the cable 39 apply a downwards pressure which guides the cable 39 into the trench 40. This may remove the requirement for the depressors 72–74.

Figure 7:
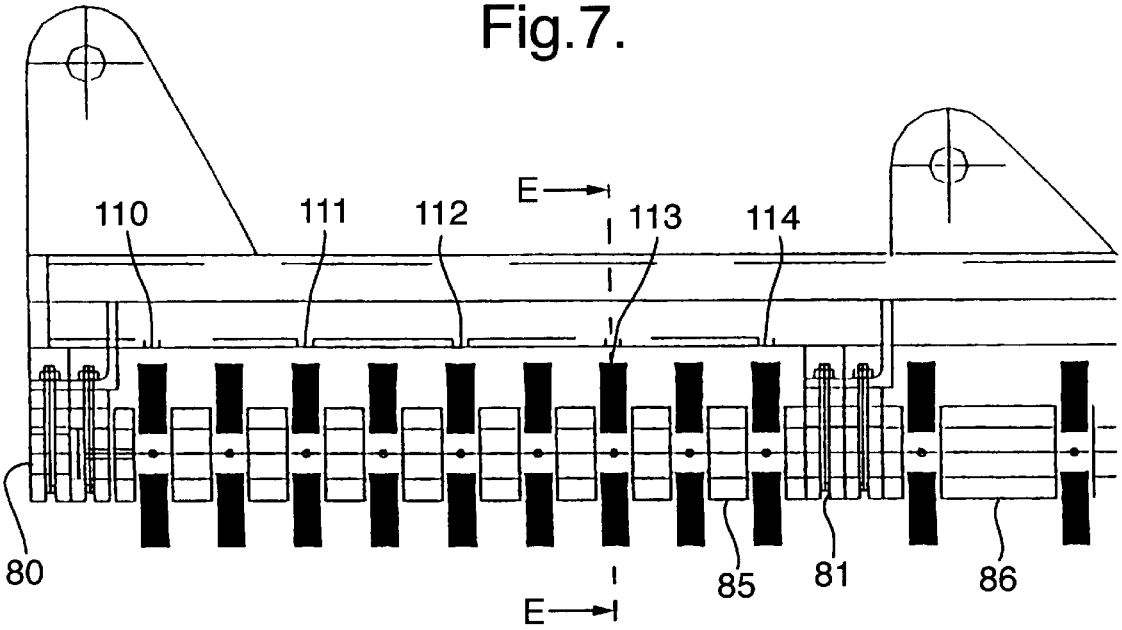
FIG. 7 is a detailed side view of the lower end of an alternative cable burial device.
Figure 8:
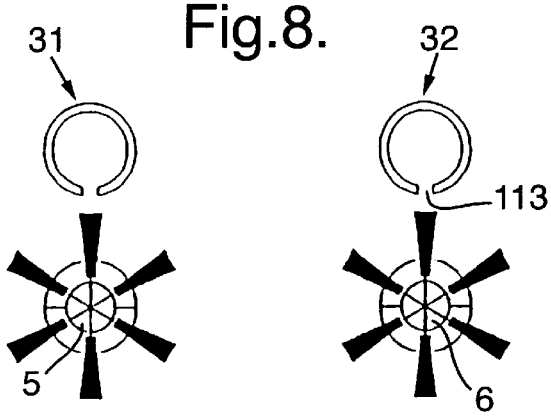
FIG. 8 is a section along line E—E in FIG. 7.

FIGS. 7 and 8 illustrate an alternative cable burial device. In this case the hollow arms 31,32 each have five holes 110–114 formed between the two rear bearings 80,81. Water is pumped along the interior of the arms 31,32 at low pressure, and is emitted from the holes 110–114 in the region of the rear brush assemblies. This provides a lubricating effect in the lower part of the trench 40 which improves the trenching efficiency.

Figure 9:
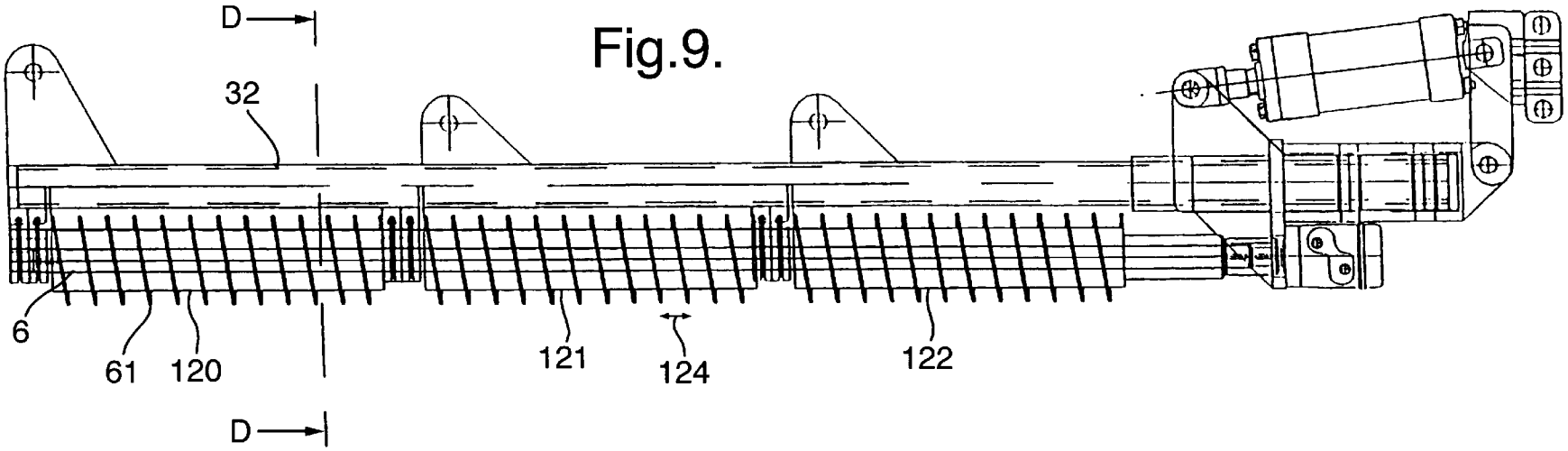
FIG. 9 is a side view of an alternative cable burial device with spiral brushes.
Figure 10:
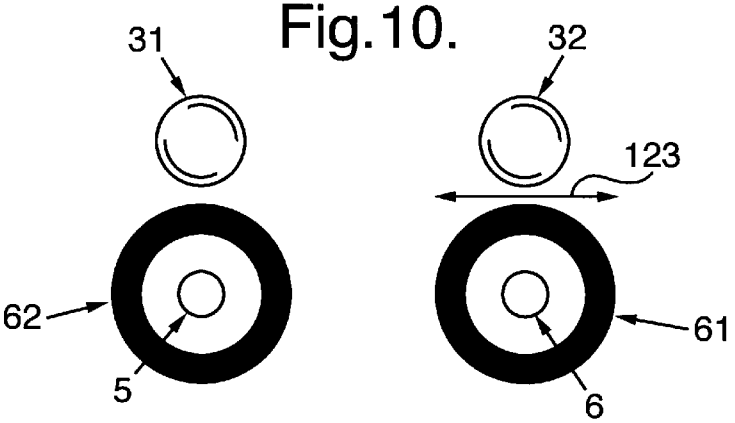
FIG. 10 is a cross-section along line D—D in FIG. 9.

FIG. 9 is a schematic side view and FIG. 10 is a section along line D—D of an alternative cable burial device 60 with spiral brushes. The device 60 is identical in all other respects to the device 29 shown in FIGS. 1–6 and identical components are indicated with the same reference numerals. In the embodiment of FIGS. 9 and 10, the brush filaments extend radially from the axles 5,6 and are arranged in a continuous spiral 61,62. The brush filaments are mounted in a spiral groove in three nylon holders 120–122. The overall diameter 123 is 140 mm, the trim length of the brush filaments is 15–20 mm, and the pitch 124 between adjacent turns of the spiral is 18–38 mm. The pitch of the spiral groove on the rear nylon brush holder 120 may be reduced to increase the brush density towards the lower end of the apparatus.

Both spirals 61,62 are right-handed spirals and both axles are rotated in the same sense. In a first example, both axles 5,6 are driven anti-clockwise (as viewed from the left of FIG. 9). In this example the auger effect of the spiral brushes causes material to move upwards away from the base of the trench. This has the advantage of enabling the removal of fluidised soil from the base of the trench. In a second example the axles 5,6 are both rotated clockwise. In this case the auger effect of the spiral brushes causes material to move downwards towards the base of the trench. This has the advantage of delivering water to the base of the trench and thereby providing a lubricating effect.

We claim:

1. In apparatus for locally disturbing an underwater bed in a line to enable the burial of an elongate member, the improvement comprising:

a mounting structurally connected to said apparatus for movement together along said line, at least one resilient member coupled to the mounting, and means for moving the at least one resilient member with respect to the mounting, said at least one resilient member being constructed such that on moving the mounting along the line while moving the at least one resilient member with respect to the mounting, the underwater bed is disturbed by the at least one resilient member to enable the elongate member to be buried.

2. Apparatus according to claim 1 including a plurality of resilient elongate members constructed and operating like and including said at least one resilient member.

3. Apparatus according to claim 2 wherein the resilient elongate members comprise brush filaments.

4. Apparatus according to any of the preceding claims wherein each resilient member is rotated with respect to the mounting.

5. Apparatus according to claim 4 wherein each resilient member extends from an axle rotatably coupled to the mounting, and wherein the means for moving the resilient member with respect to the mounting comprises a driver for rotating the axle.

6. Apparatus according to claim 5, wherein each resilient member extends radially from the axle.

7. Apparatus according to claim 5, wherein each resilient member is arranged in a plurality of arms circumferentially spaced around the axle.

8. Apparatus according to claim 5, wherein each resilient member is arranged in a plurality of groups axially spaced along the axle.

9. Apparatus according to claim 5, wherein each resilient member is arranged as a spiral extending along the length of the axle.

10. Apparatus according to claim 5 wherein the axle is mounted and deployed such that, in use, the axle lies substantially parallel to a vertical plane passing through the line.

11. Apparatus according to claim 5 further comprising a second axle rotatably coupled to the mounting substantially parallel to the first axle and having said resilient member extending therefrom.

12. Apparatus according to claim 1 further comprising guide means for guiding an elongate member into the underwater bed.

13. Apparatus according to claim 12 wherein the guide means comprises one or more depressors.

14. Apparatus according to claim 1 further comprising deployment means for deploying the mounting between a raised position and a lowered position.

15. Apparatus according to claim 14 further comprising means for pivotally attaching the mounting to an underwater vehicle, whereby the mounting pivots between its raised and lowered positions.

16. Apparatus according to claim 14 further comprising means for slidably attaching the mounting to an underwater vehicle, whereby the mounting slides between its raised and lowered positions.

17. Apparatus according to claim 1 wherein the at least one resilient member extends downwards in use into the underwater bed, and wherein the resilient member is non-uniformly distributed such that, in use, the density of the resilient member increases downwards into the underwater bed.

18. Apparatus according to claim 1 further comprising means for delivering a fluid in the region of the resilient member.

19. A remotely operated undersea vehicle comprising apparatus according to claim 1.

20. A method of locally disturbing an underwater bed in a line to enable the burial of an elongate member, the method comprising:

providing apparatus for locally disturbing an underwater bed in a line to enable the burial of an elongate member, said apparatus including a mounting structurally connected to said apparatus for movement together along said line, at least one resilient member being coupled to the mounting, and means for moving the at least one resilient member with respect to the mounting; and moving said apparatus along the line while moving the resilient member with respect to the mounting whereby the underwater bed is disturbed by the resilient member to enable the elongate member to be buried.

21. A method according to claim 20 further including deploying said elongate member by laying the elongate member along the underwater bed and burying the elongate member in the disturbed bed.

22. Apparatus according to claim 1 wherein said elongate member is flexible.

23. Apparatus according to claim 22 wherein said elongate member is a cable.

24. Apparatus according to claim 23 wherein said cable is a telecommunications cable.

* * * * *